United States Patent [19]

Rhys

[11] 3,992,287

[45] Nov. 16, 1976

[54] OIL SHALE SORTING

[76] Inventor: Hugh R. Rhys, 2420 Martin Ave. SE., Grand Rapids, Mich. 49507

[22] Filed: Feb. 27, 1975

[21] Appl. No.: 553,464

[52] U.S. Cl. ..... 209/2; 209/9; 209/11; 209/111.5; 209/111.6; 219/10.55 R; 250/253

[51] Int. Cl.[2] ..... B03B 1/02

[58] Field of Search ..... 209/73, 74, 111.5, 111.6, 209/1, 2, 3, 4, 9, 11; 219/10.55 M, 10.55 R, 10.55 A; 34/1; 208/11 R; 250/253, 255, 301

[56] References Cited

UNITED STATES PATENTS

| | | | |
|---|---|---|---|
| 1,678,884 | 7/1928 | Sweet | 209/111.6 |
| 3,560,347 | 2/1971 | Knapp et al. | 219/10.55 A |
| 3,819,805 | 6/1974 | Graves et al. | 209/111.6 X |

*Primary Examiner*—Robert B. Reeves
*Assistant Examiner*—Joseph J. Rolla
*Attorney, Agent, or Firm*—McGarry & Waters

[57] ABSTRACT

Sorting of bicarbonate containing ore particles from oil containing ore particles in a mixture of the two types of ore particles by treating the surface of the mixture with an aqueous medium and thereafter subjecting the ore particles, while wet, to microwave energy to heat the surface of the particles sufficiently to whiten the color of the bicarbonate containing particles and thereafter optically sorting the particles according to color.

13 Claims, 1 Drawing Figure

OIL SHALE SORTING

BACKGROUND OF THE INVENTION

1. Field of the Invention

This invention relates to sorting of oil shale. In one of its aspects, the invention relates to an improved method and apparatus of sorting oil shale wherein ore particles are heated quickly and without ignition of the oil to change the color of nonoil bearing particles.

2. State of the Prior Art

As liquid oil resources become scarce, interest has increased in producing oil from oil shale reserves. It is known that oil shale is mixed with nonoil bearing minerals known as nahcolite. These minerals which are normally a dark brown color similar to the color of oil shale contain mixtures of bicarbonates which, when heated in the presence of air, turn a whitish color. It has been found that such minerals, after heating, can be optically sorted according to color to sort the nahcolite hearing minerals from the oil-bearing minerals.

It has been proposed to heat such minerals by direct or indirect heat. Such heating, while achieving the color change desired, also tends to heat large portions of the ore requiring large amounts of energy, and in some cases, even can cause ignition or oxidation of the oil in the ore-bearing rock. Further, special atmospheric conditions are required to prevent ignition of the oil.

SUMMARY OF THE INVENTION

According to the invention, mixtures of bicarbonate containing ore particles and oil containing ore particles are treated with an aqueous medium and thereafter, while still wet, subjected to a high level of directional microwave energy to heat only the surface of the particles sufficiently to whiten the color of the bicarbonate particles. The directional microwave energy, typically at 2450 MHz, produces localized heat on the surface of the particles by rapid molecular vibration at the particles' surfaces. Thereafter, the particles can be optically sorted according to color to sort the bicarbonate particles from the shale particles. The surface of the bicarbonate particles are at least partially oxidized to a carbonate by the heating process. Desirably, the level of the microwave energy is relatively high, in the range of 500 watts/dm$^2$ to 750 watts/dm$^2$, and the particles are subjected to the microwave energy from 30 to 90 seconds.

The aqueous treating can take place by spraying steam or water on the particles and is believed to assist in the surface heating process. In one embodiment of the invention, the mixture of ore particles comprises nahcolite and shale.

Also, according to the invention, there is provided a means for treating a mixture of oil shale and bicarbonate-containing ore particles with an aqueous fluid, means for subjecting the aqueous fluid treated mixture to microwave energy for a period of time at an energy level sufficient to heat only the surface of the wet particles sufficiently to whiten the bicarbonate-containing ore particles. Means are provided for conveying the mixture of bicarbonate and oil shale particles from the aqueous treating means to the microwave energy subjecting means while the particles are wet. Means are provided for optically sorting the particles according to color to sort the bicarbonate particles from the oil shale particles. Desirably, means are provided for conveying the particles from the microwave subjecting means directly to the optical sorting means.

BRIEF DESCRIPTION OF THE DRAWING

The invention will now be described with the reference to the accompanying FIGURE which illustrates schematically the sorting of nahcolite from oil shale by microwave heating and optical sorting techniques.

DESCRIPTION OF THE PREFERRED EMBODIMENT

Figure 1:
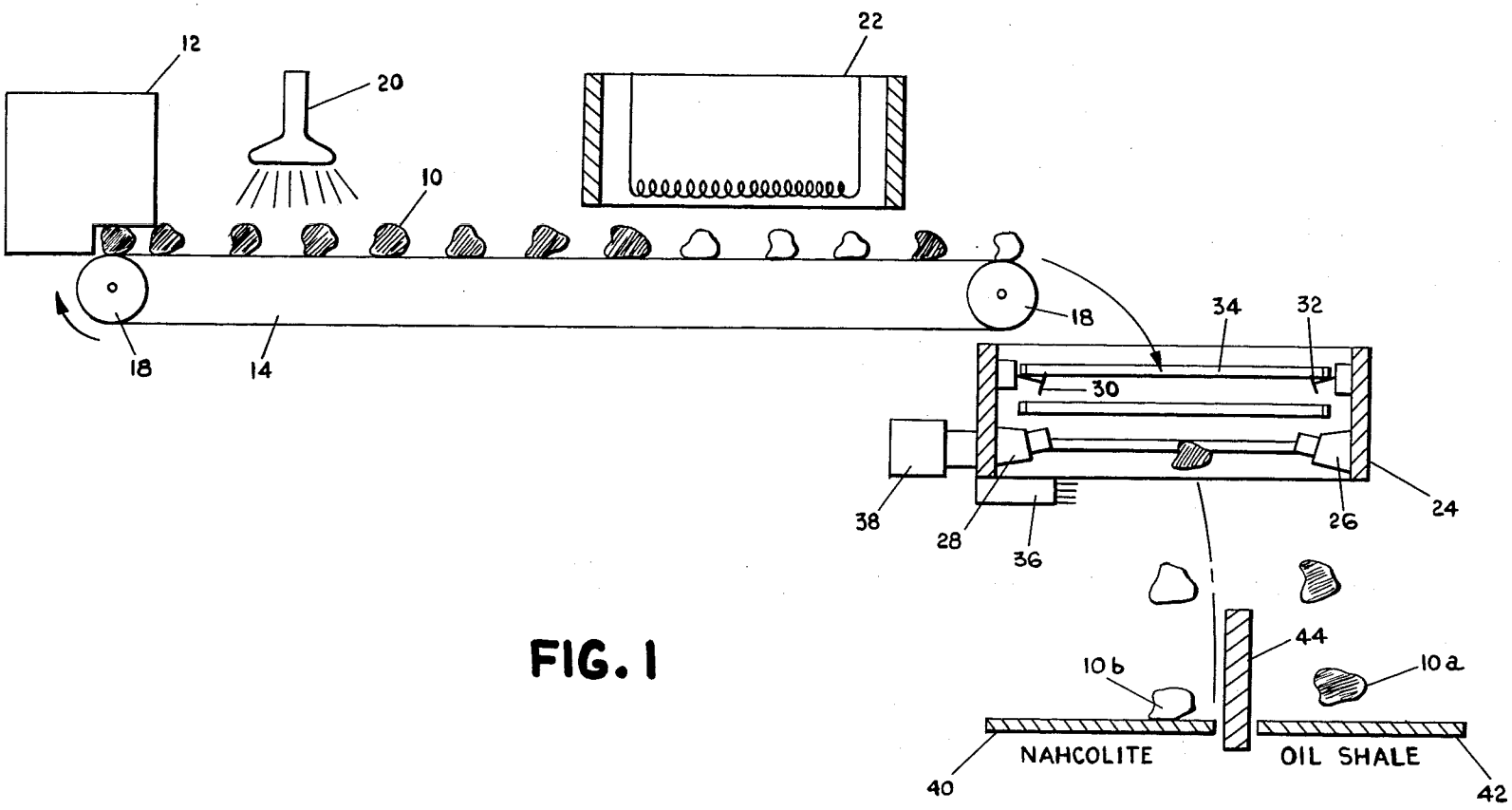

Referring now to the drawing, ore particles 10 containing nahcolite and oil shale are deposited on a continuous belt 14 to a hopper 12. The continuous belt 14 is trained around pulley wheels 16 and 18. The ore particles are passed beneath a spray head 20 which sprays the particles with water or steam. The wet particles are then passed beneath a microwave energy emitter, such as a magnetron, wherein the particles are heated rapidly as they pass therebeneath so that the surface of the particles reaches a temperature of about 1,000° centigrade. The rapid heating of the surface of the ore particles changes the surface color of the nahcolite to a whitish color. It is believed that the color change is associated with the conversion of the nahcolite from an impure bicarbonate to the normal carbonate. Heating of 30 to 90 seconds by microwaves is usually sufficient to raise the surface temperature of the nahcolite sufficiently to cause the color change. This time may be substantially reduced by increased, and possibly pulsed, energy.

As the ore particles are passed from the end of the belt 14, they fall freely through an optical box 24 wherein they are viewed for color. The optical box comprises a pair of optical viewers 26 and 28 disposed across the opposite sides of the sorting box and a pair of adjustable backgrounds 30 and 32 diametrically opposite from the optical viewers 26 and 28 respectively. The optical viewer 26 is aligned to view the ore particles passing through the optical box 24 against the background 30. Optical viewer 28 views the particles against the background 52. Both of the backgrounds 30 and 32 are adjustable in a well-known manner so that the reflectivity thereof can be altered by adjusting the relative position of the background with respect to the optical viewer. If the particles continue on their trajectory path, they will fall onto conveyor 40. In order to sort the particles, an ejector 28 is positioned beneath the optical box 24. The ejector is an air ejector preferably of a well-known type as for example is disclosed in the Fraenkel U.S. Pat. No. 3,053,497. The ejector 36 is electronically coupled to the optical viewers 28 and 26 through a decision circuit 38. If the particles are darker than a predetermined color as viewed by the optical viewing means 26 and 28, the decision circuit generates and applies a pulse to the ejector 36 to deliver a pulse or blast of air across the bottom of the optical box 24. The blast is timed so that the particle viewed by the optical viewers 26 and 28 is positioned adjacent to the ejector 36 as the blast of air is delivered. The particle is thus deflected from its trajectory path and falls onto the reject conveyor 42. A splitter plate 44 separates the conveyor 40 from the conveyor 42. In a practical application of the invention, those particles which are darker than a predetermined standard are ejected with the air ejector onto the conveyor 42. Thus particles 10*a*, the darker particles, are the oil shale which fall onto conveyor 42 and the lighter or nahcolite particles 10*b* fall onto the conveyor 40.

The size of the particles can vary over a large range. However, particles in the range of 1/10 of an inch to 2 inches are preferable. Desirably, such particles are crushed in an ore crusher prior to feeding to hopper 12 for sorting purposes.

The energy applied by the microwave oven 22 can also vary over a wide range. The energy level is adjusted with respect to the time which the particles are beneath the microwave oven 22 so that the nahcolite particles effectively undergo the color change. Generally, the particles will remain under the microwave oven for 30 to 90 seconds and the energy density level will be in the range of 500 watts/dm$^2$ to 750 watts/dm$^2$.

Although the invention has been described with reference to sorting of particles according to color after microwave heating, other sorting techniques can be used. For example, ore particles which are heated in a reducing atmosphere in order to promote the reduction of their surface to an electrically conductive surface, may be sorted, using a conductivity sorter or high tension separator, according to their so-created surface conductivity differential.

The invention will be further illustrated with reference to the following example.

A mixture of oil-bearing shale, some which contained discrete crystals (as opposed to finely dissiminated particles) of nacholite, and some of which were entirely barren of such a mineral, was crushed and screened to about ⅝ to ¼ inch. At this size many of the discrete crystals were liberated to a degree that they were plainly exposed on the surface of the finely crystalline, and essentially homogenous oil shale particles. Such nahcolite crystals, of sizes ranging from about ⅛ to ¼ inch or more were of a dark brown, or shiny black color and, when viewed against the brown background of their host rock, oil shale, would not be distinguishable by the photometric sensors of conventional optical sorting machines.

The rocks were sprayed with finely atomized water using a water spray bottle which originally contained a window cleaning spray. When the surface was thoroughly wet the rocks were placed on a boro-silicate glass tray, and placed in a microwave oven. The magnetron was then energized in the usual way. After such exposure for 90 seconds thr rocks were withdrawn. The shale particles containing exposed nahcolite crystals exhibited vivid white blotches which, on examination, were shown to delineate, and cover all the exposed surfaces of the nahcolite, and only the nahcolite. Such shale particles that were barren of exposed nahcolite remained free of color change.

It was then clear, based on previous tests of shale/-nahcolite optical sorting after the nahcolite had been whitened by other heating methods, that the brown/-white particulate mixture could be sorted according to color.

The microwave treatment was repeated using steam wetting (condensing from exposure of the rocks to a wet steam stream obtained from boiling water in an ordinary domestic bottle) as well as the spray method previously described. Radiation exposure times of as little as 30 seconds were used and a similar color change phenomenon was observed. The degree of color change decreased markedly as the radiation exposure time was reduced, but even at the minimum exposure time the results were judged to be sufficient for optical sorting.

Reasonable variation and modification are possible within the scope of the foregoing disclosure and drawings without departing from the spirit of the invention which is defined in the appended claims.

The embodiments of the invention in which an exclusive property or privilege is claimed are defined as follows:

1. A process for sorting bicarbonate-containing ore particles from oil-containing ore particles in a mixture of the two ore particles, the process comprising:
- treating the surface of the mixture of ore particles with an aqueous medium;
- thereafter subjecting the ore particles, while wet, to directional microwave energy to heat the surface of the particles sufficiently to whiten the surface of the bicarbonate-containing ore particles; and
- optically sorting the ore particles according to color to sort the bicarbonate-containing particles from the oil-containing particles.

2. A process for sorting according to claim 1 wherein the particles are subjected to said microwave energy for 30 to 90 seconds.

3. A process for sorting according to claim 1 wherein the surface treating step comprises subjecting the particles to a water spray.

4. A process for sorting according to claim 1 wherein the surface treating step comprises subjecting the ore particles to a spray of steam.

5. A process for sorting according to claim 1 wherein the surface of the bicarbonate-containing ore particles are at least partially oxidized to a carbonate form thereof by the heating with microwave energy.

6. A process for sorting according to claim 5 wherein the particles are subjected to the microwave energy for 30 to 90 seconds.

7. A process according to claim 6 wherein the surface treating step comprises subjecting the particles to a water spray.

8. A process for sorting according to claim 6 wherein the surface treating step comprises subjecting the particles to a spray of steam.

9. An apparatus for sorting bicarbonate-containing ore particles from oil-containing ore particles in a mixture of the two ore particles the apparatus comprising:
- means for treating the mixture of ore particles with an aqueous fluid;
- means for subjecting the mixture of oil containing ore and bicarbonate-containing ore particles to microwave energy for a period of time and at an energy level to heat the surface of the wet particles sufficiently to whiten the bicarbonate-containing particles;
- means for conveying the mixture of ore particles from the aqueous treating means to the microwave energy subjecting means while the particles are wet;
- means for optically sorting the particles according to color after the mixture has been subjected to the microwave energy to sort the bicarbonate-containing particles from the oil-containing particles.

10. An apparatus for sorting according to claim 9 wherein said fluid treating means comprises means for spraying water onto the particles.

11. An apparatus for sorting according to claim 9 wherein the fluid treating means comprises means to spray the mixture with steam.

12. An apparatus for sorting according to claim 9 and further comprising means for conveying the particles from the microwave subjecting means to the optical sorting means.

13. An apparatus for sorting according to claim 12 wherein the first and second conveying means comprise a continuous conveyor.

* * * * *